United States Patent [19]

Gonzales

[11] Patent Number: 4,828,025

[45] Date of Patent: May 9, 1989

[54] BLOWOUT CONTROL MEANS

[75] Inventor: Abe P. Gonzales, Snyder, Tex.

[73] Assignee: MRW Partnership, Snyder, Tex.

[21] Appl. No.: 195,139

[22] Filed: May 17, 1988

[51] Int. Cl.[4] ..... E21B 33/06

[52] U.S. Cl. ..... 166/95; 166/97

[58] Field of Search ..... 166/95, 97, 91, 85, 166/75.1, 363, 79; 285/319, 309, 310, 374; 294/86.26, 86.27, 86.3, 86.31, 86.32, 86.33, 86.34

[56] References Cited

U.S. PATENT DOCUMENTS

| | | | |
|---|---|---|---|
| 910,295 | 1/1909 | Layne | 166/95 X |
| 1,323,660 | 12/1919 | Thrift | 166/97 |
| 1,485,862 | 3/1924 | Lester | 166/97 |
| 1,557,480 | 10/1925 | Plante | 285/319 |
| 1,629,022 | 5/1927 | Davis et al. | 166/95 |
| 1,662,311 | 3/1928 | Hamer | 166/85 |
| 1,713,364 | 5/1929 | Arbon | 251/212 X |
| 1,831,878 | 11/1931 | Myracle | 166/85 X |
| 1,874,889 | 8/1932 | Burris | 166/79 |
| 1,928,821 | 10/1933 | Santiago | 166/95 X |
| 2,793,700 | 5/1957 | Eckel | 166/95 |
| 2,897,895 | 8/1959 | Ortloff | 166/95 |
| 3,241,864 | 3/1966 | Shaffer | 166/85 X |
| 3,958,642 | 5/1976 | Coone | 166/85 X |
| 4,192,376 | 3/1980 | Lissmyr | 166/87 X |
| 4,246,967 | 1/1981 | Harris | 166/75.1 X |
| 4,442,892 | 4/1984 | Delesandri | 166/85 |
| 4,461,354 | 7/1984 | Buras et al. | 166/343 |

FOREIGN PATENT DOCUMENTS

| | | | |
|---|---|---|---|
| 956746 | 9/1982 | U.S.S.R. | 166/79 |

*Primary Examiner*—Hoang C. Dang

*Attorney, Agent, or Firm*—Wendell Coffee

[57] ABSTRACT

A controller for oil well blowouts includes a barrel that fits closely around the collar connected to tubing extending into the oil well. The controller is placed over the collar so that the collar buts against a resilient ring so that the top of the collar is sealed by the ring to the barrel. The collar is pushed against the top by fingers of a collet. The collet is pushed upward by a nut that is on the bottom of the barrel.

10 Claims, 2 Drawing Sheets

BLOWOUT CONTROL MEANS

BACKGROUND OF THE INVENTION (1) Field of the Invention

This invention relates to oil well blowout control and more particularly to preventing the blow from tubing within a casing or through the drill stem of drill pipe.

(2) Description of the Related Art

As used herein, "oil well" is used to include wells producing either oil or gas.

Oil wells often have tremendous pressures deep within the earth. These pressures are normally controlled by the weight of mud within the well. However, certain times, unbalance occurs and it is possible for the well to blow, i.e., the pressure within the earth force the mud, gas, oil, and other fluids up with tremendous force. The fluids from within the earth may be forced up between the casing and the tubing (or between the well and the drill stem). There exist blowout preventers for controlling the flow of fluid in the annular space between the casing and tubing. Also, there is often a flow of fluid through the tubing (or drill stem) itself.

This application relates to preventing the flow of fluid from the tubing or drill stem. Normally, when working over the well, the tubing will be either removed from the well or run into the well a joint at a time. Normally, the tubing will be held above the surface of the ground with a collar on the end of the tubing. This is the case either when the tubing is being removed or run in the well.

Normally, the tubing and the collars will have standard dimensions. One standard size tubing used in oil field equipment is 2⅜" outside diameter. This size tubing is used as an example in this application. However, it will be understood that there are other size tubings widely used in the oil field. Also, this invention is applicable to a drill stem which has its own sizes.

With 2⅜" tubing, the collars will have a 3" outside diameter and a length of about 4½" to 5½".

Before this application was filed, the applicant was aware of the following United States patents:

| Inventor | U.S. Pat. No. |
|---|---|
| Thrift | 1,323,660 |
| Hamer | 1,662,311 |
| Arbon | 1,713,364 |
| Burris | 1,874,889 |
| Coone | 3,958,642 |
| Lissmyr | 4,192,376 |
| Delesandri | 4,442,892 |
| Buras et al | 4,461,354 |

Applicant believes the information found in these patents is not as pertinent as the information specifically discussed above. These inventions show other devices to perform similar tasks. However, applicant believes that the Examiner would be interested in any patent found by an experienced patent searcher.

SUMMARY OF THE INVENTION (1) Progressive Contribution to the Art

I have invented a compact controller which is small in size and inexpensive. With a small inexpensive controller, it can be present at all times on the rigs where either tubing is being pulled or run into the well or when drilling takes place. The controller would be for the size of tubing being worked.

Basically, the controller includes a barrel which fits rather closely around the collar. The top of the collar buts against a resilient ring so that the top of the collar is sealed by the ring to the barrel. The collar is pushed against the top by fingers of a collet. The collet is pushed upward by a nut that is on the bottom of the barrel. Therefore, the controller can be placed over the collar on the top of tubing of a well which is blown. Then with one or two rotations of the nut, the collet can be pushing the fingers of the collet against the bottom of the collar.

(2) Objects of this Invention

An object of this invention is to seal a valve to the tubular goods of an oil well that has blown out.

Further objects are to achieve the above with devices that are sturdy, compact, durable, lightweight, simple, safe, efficient, versatile, ecologically compatible, energy conserving, and reliable, yet inexpensive and easy to manufacture, connect, operate and maintain.

Further objects are to achieve the above with a product that is easy to store, has a long storage life, is safe, versatile, efficient, stable and reliable, yet is inexpensive and easy to manufacture and use.

The specific nature of the invention, as well as other objects, uses, and advantages thereof, will clearly appear from the following description and from the accompanying drawing, the different views of which are not scale drawings.

Figure 1:
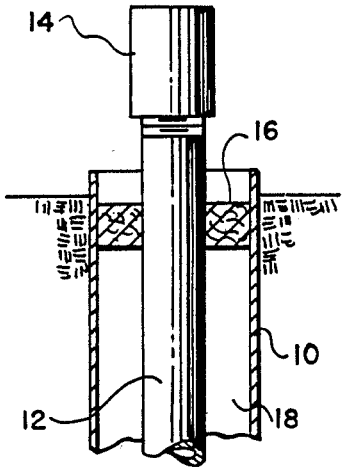
FIG. 1 is a schematic representation of an oil well upon which a controller would be used.

As an aid to correlating the terms of the claims to the exemplary drawing, the following catalog of elements and steps is provided:

10 casing
12 tubing
14 collar
16 blowout preventer
18 annulus
20 controller
22 body
24 top
26 bottom
28 barrel
30 bore
32 shoulder
34 resilient ring
36 valve
38 top threads
40 collet
42 collet ring
44 collet fingers
46 collet cavity
48 collet taper
50 nut
52 nut threads
54 external threads 56 nut flange
60 brass ring
62 set screws
64 handles
66 ears
68 lugs
70 snaps
72 lifting loop
74 bevel
76 wrench flats

DESCRIPTION OF THE PREFERRED EMBODIMENT

Referring to the drawings there may be seen a schematic representation of the top of an oil well. As may be seen, there is casing 10 projecting above the top of the ground. Tubing 12 is telescoped within the casing and it extends above the top of the ground also. Collar 14 is threaded onto at the top of the tubing 12. The tubing has a top and an outside diameter. The collar 14 also has an outside diameter, a length, a top, and a bottom. The term "tubular goods" includes tubing and drill stem. Collars on drill stems are welded thereto.

It will be understood that if the pressures build up sufficiently within the well, the well will "blow out". I.e., the pressures will force liquids, gases, and the like upward through the tubing 12. They would also be blown up through the annular space 18 between the tubing 12 and the casing 10; however, blowout preventer 16 would prevent this. It is understood that the blowout preventer 16 is schematically shown inasmuch as the prevention of the blowout between the tubing 12 and the casing 10 is not a portion of this invention. This invention concerns only the stoppage of the blow through the tubing 12 itself.

Figure 3:
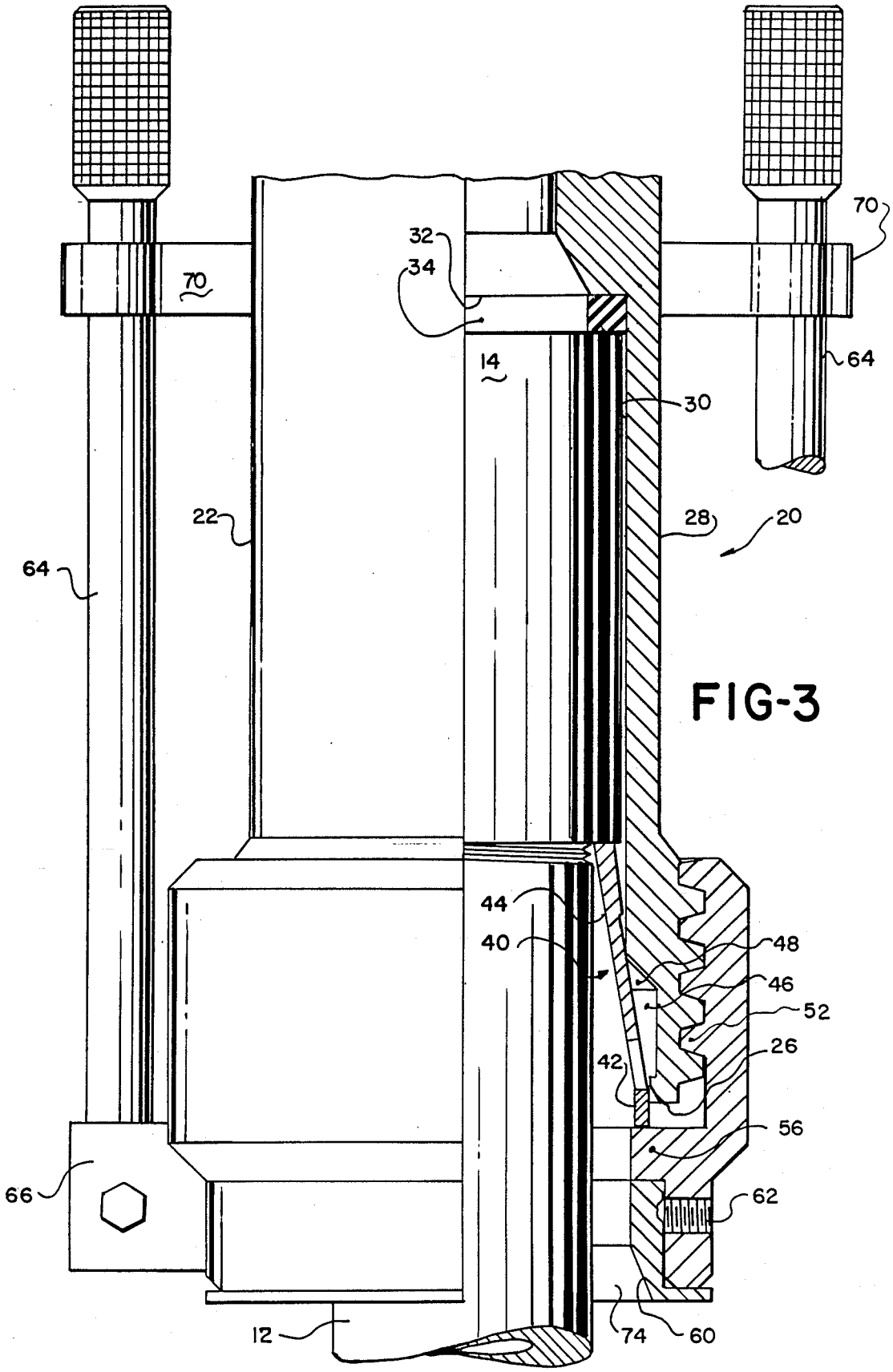
FIG. 3 is a front elevational view in half section showing the controller which has been sealed onto a collar of oil well tubing.

According to my invention controller 20 is provided for this purpose. The controller 20 will include body 22. The body is tubular and has top 24, bottom 26, and barrel 28. As readily seen in FIG. 3, the barrel 28 has an internal bore 30 extending through it. The internal bore 30 has an inside diameter which is greater than the outside diameter of the collar 14. The bore 30 also has a length greater than the collar length.

Shoulder 32 is located between barrel 28 and top 24 of body 22. Shoulder 32 projets inward from internal bore 30 of the barrel. Resilient ring 34 is located in the barrel bore 30 against the internal flange 32. The resilient ring 34 forms a part of seal means for sealing the top of the collar 14 to the shoulder 32. It may be seen that when the collar 14 is sealed to shoulder 32, it is sealed to the body 22.

Threads 38 at the top 24 of the body 32 form means for connecting valve 36 to body 22.

Therefore, it may be seen that with the body 22 sealed to the tubing 12 through the collar 14, and with the valve 36 closed, the blowout will be controlled. Furthermore, it will be understood that conduits could be connected to valve 36 and valve 36 opened a controlled amount to drain off the liquids and gas causing the blowout so that further work could be done.

Collet 40 has an inside diameter greater than the outside diameter of the collar 14. The collet includes collet ring 42 and collet fingers 44. The collet is located within collet cavity 46 at the bottom 26 of the body 22. The collet cavity has an inside diameter larger than the inside diameter of the bore 30 of the barrel 28. Also, the collet cavity 46 has an inside diameter larger than the outside diameter of the collet 40.

Collet taper 48 is between the collet cavity 46 and the barrel bore 30. It may be seen in FIG. 2, that in the standby condition, that the collet fingers 44 are adjacent to the collet taper 48.

Nut 50 is threaded by internal nut threads 52 to the body 22 by external threads 54 on the bottom 26 of the body 22. Nut flange 56 is an internal flange in the nut 50. The inside diameter of the nut flange 56 is greater than the outside diameter of the collar 14. The collet ring 42 rests upon the nut flange 56. As may be seen, the nut flange 56 extends inwardly from the internal nut threads 52.

Brass ring 60 is attached to the bottom of the nut 50. I prefer to attach the brass rings by at least two set screws 62 extending through the nut 50 into a groove in the brass ring 60.

Rotating handles 64 are pivoted to the nut at ears 66. The handles have lugs 68 thereon so that the handles may be rotated downward into a radial position extending radially from the nut. However, the lug 68 prevents further downward pivoting of the handle 64. The handle 64 can be pivoted upward to a position parallel to the axis of the controller 20, at which time they may be held in place by snaps 70.

A pair of lifting loops 72 are attached to the controller 20 at the barrel 28.

Figure 4:
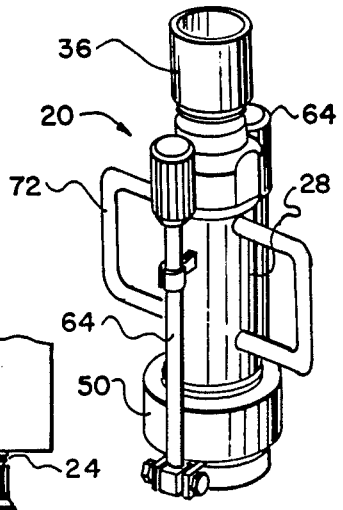
FIG. 4 is a perspective view of the controller in the standby condition.
Figure 2:
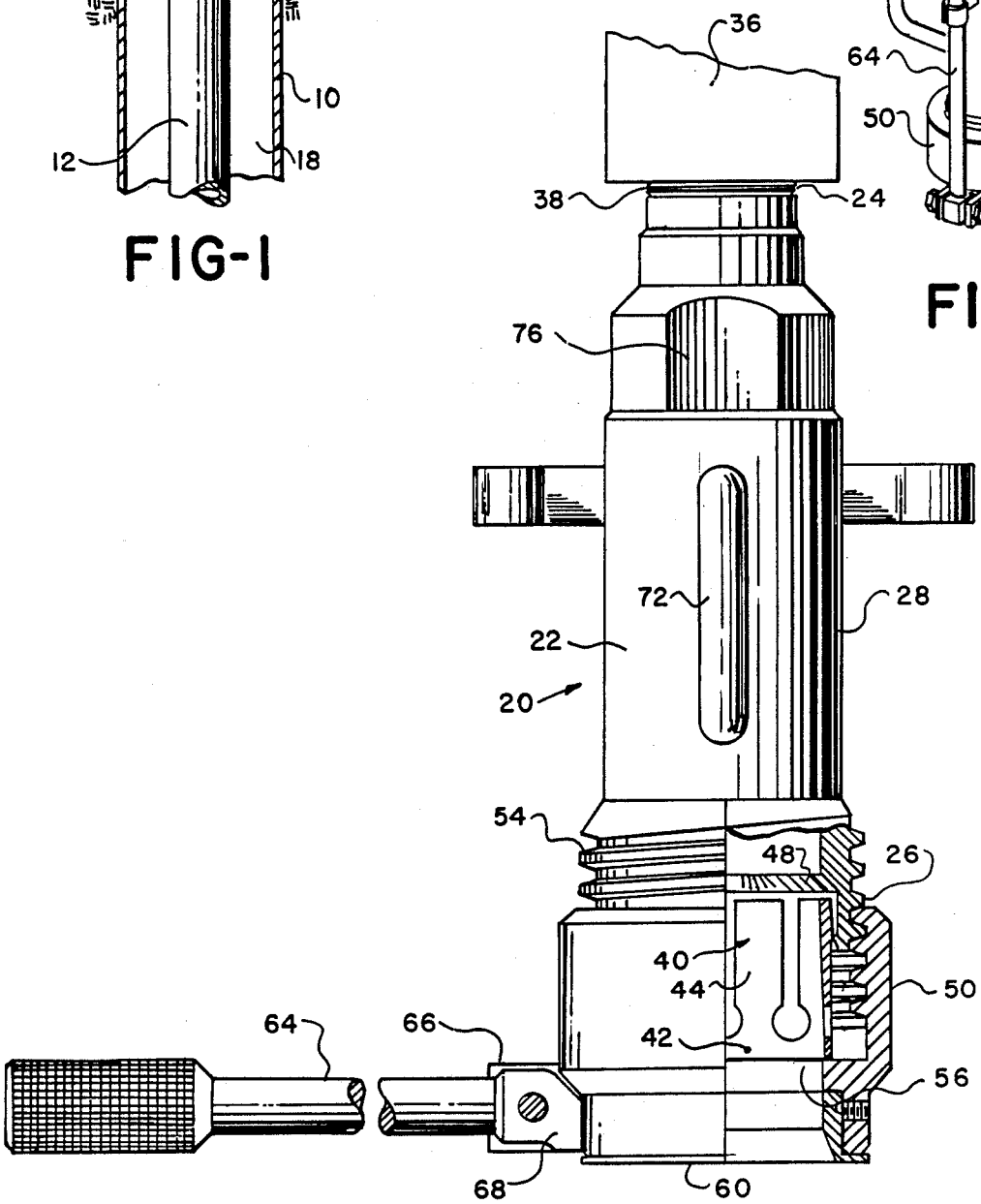
FIG. 2 is a front elevational view of the controller with parts broken away to illustrate the controller in the standby condition.

In use, normally the controller 20 would be maintained on the rig wherein work was being done upon the oil well at any time the tubing 12 was being pulled or run into the hole or other work was being done. Normally the condition of the controller would be that as shown in FIGS. 2 and 4, with the handles rotated upward in snaps 70. Thus, the nut is held in a position where is will not compress the collet 40.

In case of a well blowout, the controller 20 could be readily picked up by the lifting loops 72 and brought so that the controller could be placed over the collar 14. It is understood that this is a critical operation to place the controller over the collar inasmuch as there will be a great flow of fluids through the tubing 12. The valve 36 is opened at this time. Inasmuch as there is likely to be considerable banging of the controller in getting it on the collar 14, the brass ring 60 is provided so that there will be no sparks produced at this time, which otherwise might ignite flammable gas or fluids being blow from the well. Also, as seen, the brass ring is provided with a bevel 74 at its lower opening to assist is fitting the controller over the collar 14.

As soon as the controller 20 is over the collar 14, it is moved downward until the top of the collar 14 is against the resilient ring 34. At this time the handles 64 are pulled down to a radial position and the nut is rotated upon the body 22. The lifting loop 72 can be used to prevent the body 22 from being rotated with the nut 50. Also, wrench flats 76 are provided near the top 24 of the body so that a wrench may be attached to the body if needed. Also, it will be noted that the nut threads 52 and external threads 54 between the nut and the body are #2 A.S. Acme threads. These threads will have a pitch of 2 threads per inch so that the nut will move upward on the body with one or two revolutions of the nut. With the revolutions of the nut and bringing the nut up on the body, the collet 40 will be moved upward inasmuch as the collet ring 42 rests upon nut flange 56. As the collet is moved upward, the fingers will engage the collet taper 48 upon the body and move inward and engage the bottom of the collar 14. As they engage the bottom of the collar 14, they will compress the resilient ring 34 to form a fluid tight seal. As soon as this occurs, valve 36 may be closed and the escape of gases and liquids from the tubing is terminated.

The embodiment shown and described above is only exemplary. I do not claim to have invented all the parts, elements or steps described. Various modifications can be made in the construction, material, arrangement, and operation, and still be within the scope of my invention.

The restrictive description and drawing of the specific examples above do not point out what an infringement of this patent would be, but are to enable one skilled in the art to make and use the invention. The limits of the invention and the bounds of the patent protection are measured by and defined in the following claims.

I claim as my invention:

1. A blowout control means for an oil well having:

a. a joint of tubing with a top extending from the well, b. said tubing having an outside diameter, and c. a collar threaded to the top of the tubing, d. said collar having:

i. an outside diameter, ii. a length, iii. a top, and iv. a bottom, wherein said improved blowout control means comprises:

e. a tubular body with i. a top, ii. a bottom, and iii. means on the top of the body for connecting a valve to the body, f. a barrel defined by a portion of the body, said barrel having an internal bore having a diameter greater than the outside diameter of the collar and a length greater than the collar length, g. a shoulder between the barrel and the top of the body projecting inward from the internal bore of the barrel, h. a resilient ring in the barrel bore against the shoulder, j. said resilient ring being a part of seal means for sealing the top of the collar to the shoulder, and thus the body, k. a collet having an inside diameter greater than the outside diameter of the collar, l. a collet ring on the collet, and m. collet fingers on the collet, n. a collet cavity at the bottom of the body having a diameter larger than the inside diameter of the barrel, o. a collet taper between the collet cavity and the barrel, p. said collet in the collet cavity with the collet fingers adjacent the collet taper, q. external threads at the bottom of the body, r. a nut, having a minimum inside diameter greater than the collar outside diameter so that the nut may be telescoped over the collar, s. internal threads in the nut mated to the external threads of the body, t. an internal flange in the nut extending inward from the internal threads, and u. the collet ring contacting the internal flange in the nut.

2. The invention as defined in claim 1 further comprising:

v. a brass ring attached to the bottom of the nut to prevent sparks during rough handling.

3. The invention as defined in claim 1 further comprising:

v. a valve attached to the top of the body.

4. The invention as defined in claim 1 further comprising:

v. handles on the nut extending radially outward therefrom for tightening said nut to said body.

5. The invention as defined in claim 4 further comprising:

w. clamps on the body, x. said handles pivoted to the nut so they may be folded upward and clamped within the clamps on the body.

6. The invention as defined in claim 1 further comprising:

v. said nut, collet, and body telescoped over a collar on top of tubing of an oil well, w. said nut threaded upon the external threads at the bottom of the body so that the fingers of the collet are collapsed by a collet taper and push against the bottom of the collar so that the top of the collar is sealed by the resilient ring to an internal flange at the top of the barrel.

7. The invention as defined in claim 6 further comprising:

x. a valve attached to the top of the body.

8. The invention as defined in claim 7 further comprising:

y. handles on the nut extending radially outward therefrom for tightening said nut to said body.

9. The invention as defined in claim 8 further comprising:

z. clamps on the body, aa. said handles pivoted to the nut so they may be folded upward and clamped within the clamps on the body.

10. The invention as defined in claim 9 further comprising:

bb. a brass ring attached to the bottom of the nut to prevent sparks during rough handling.

* * * * *